US010342278B1

(12) United States Patent
Blau et al.

(10) Patent No.: US 10,342,278 B1
(45) Date of Patent: Jul. 9, 2019

(54) APPARATUS FOR SECURING AND POSITIONING THE END OF A HYDRATION TUBE NEAR A MOUTH

(71) Applicants: Gary Blau, Ventura, CA (US); Vaughn Colosanti, Ventura, CA (US)

(72) Inventors: Gary Blau, Ventura, CA (US); Vaughn Colosanti, Ventura, CA (US)

( * ) Notice: Subject to any disclaimer, the term of this patent is extended or adjusted under 35 U.S.C. 154(b) by 0 days.

(21) Appl. No.: 16/133,667

(22) Filed: Sep. 17, 2018

(51) Int. Cl.
*A42B 3/04* (2006.01)
*A45F 3/16* (2006.01)
*A42B 3/06* (2006.01)

(52) U.S. Cl.
CPC ..... *A42B 3/048* (2013.01); *A45F 3/16* (2013.01); *A42B 3/066* (2013.01)

(58) Field of Classification Search
CPC ..... A42B 3/048; A42B 3/066; A42B 1/24; A45F 3/16; B67D 2210/00131
See application file for complete search history.

(56) References Cited

U.S. PATENT DOCUMENTS 4,681,244 A * 7/1987 Geddie ..... A42B 3/048 222/144.5
4,739,905 A * 4/1988 Nelson ..... A42B 3/048 2/422
5,970,523 A * 10/1999 Atkins ..... A42B 1/24 2/195.1
5,984,145 A 11/1999 McAllister
6,105,827 A 8/2000 Rowan
6,199,729 B1 * 3/2001 Drzymkowski ..... A45F 3/20 138/120
6,283,344 B1 * 9/2001 Bradley ..... A42B 1/24 222/175
7,490,740 B2 * 2/2009 Robins ..... A45F 3/20 222/175
9,179,724 B1 11/2015 Schultz et al.
2007/0028359 A1 2/2007 Robinson et al.
2017/0035136 A1 2/2017 Van Heerden et al.

FOREIGN PATENT DOCUMENTS

CN 2621460 Y 6/2004
WO 9119428 A1 12/1991

* cited by examiner

*Primary Examiner* — Corey N Skurdal
(74) *Attorney, Agent, or Firm* — Loza & Loza, LLP; David S. Sarisky

(57) ABSTRACT

An apparatus for positioning an output end of a hydration tube near a region of a user's mouth includes an arm and a mounting mechanism. The arm is formable to extend in a generally vertical direction along a side of the user's head or neck and in a generally horizontal direction toward the user's mouth. The arm includes a side region and a front region coupled to the side region. The front region is configured to have a portion of the hydration tube including the output end attached thereto and subsequently detached therefrom without affecting the structural integrity of the front region or the hydration tube. The mounting mechanism is associated with the arm and is configured to attach the arm to a body gear configured to be worn near the user's head or neck, and subsequently detach the arm from the body gear without affecting the structural integrity of the arm and the body gear.

16 Claims, 11 Drawing Sheets

APPARATUS FOR SECURING AND POSITIONING THE END OF A HYDRATION TUBE NEAR A MOUTH

TECHNICAL FIELD

The present disclosure relates generally to hydration delivery systems for sports environments, and more particularly, to an apparatus for securing and positioning the end of a hydration tube near a region of a user's mouth.

BACKGROUND

An athlete competing in events such as bicycling, canoeing, rowing, and other sports where the hands are occupied needs a hydration delivery system for water and other fluids which is convenient and can be operated without using the hands. The athlete must stay properly hydrated during endurance sports activities but needs to do it without using the hands. The system should be light, simple, adjustable and easy to use. Previous systems have had inconvenient designs that cause fumbling with the tubing or having to use the hands to drink.

An example of a hands-free hydration delivery system is illustrated in U.S. Pat. No. 5,060,833 to Edison, entitled "Camel Back", which disclosure is incorporated herein by reference. This system employs a flexible back pack worn on the back of a bicyclist and connected via a detachable connector to a length of tubing having a tube end with a deformation-type bite valve held in the user's lips and teeth. An issue with these personal hydration delivery systems is that the tube is left dangling, such that release of the output end of the tube from the user's mouth results in the tube falling away from the mouth and requiring the user to retrieve the tube by hand.

Another example of a hands-free hydration delivery system is illustrated in U.S. Pat. No. 6,283,344 to Bradley, entitled "Hands Free Personal Hydration Delivery System", which disclosure is incorporated herein by reference. This system employs a complex, multi-part tube system having a middle segment that couples to a helmet, a rear segment that couples to the middle segment at one end and a hydration tube of a back pack at another end, and a front segment that couples to the middle segment at one end and dangles to the side of the user's head. Aside from the overly complex nature of this system, an issue with this system is that the front segment may be subject to downward forces when the user grabs it and may disconnect from the middle segment, thus leaving the user without access to water.

It is therefore desirable to provide an apparatus for securing and positioning the output end of a hydration tube near a region of a user's mouth such that the user can easily and repeatably release and retrieve the output end of the tube using only his mouth.

SUMMARY

An apparatus for positioning an output end of a hydration tube near a region of a user's mouth includes an arm and a mounting mechanism. The arm is formable to extend in a generally vertical direction along a side of the user's head or neck and in a generally horizontal direction toward the user's mouth. The arm includes a side region and a front region coupled to the side region. The front region is configured to have a portion of the hydration tube including the output end attached thereto and subsequently detached therefrom without affecting the structural integrity of the front region or the hydration tube. The mounting mechanism is associated with the arm and is configured to attach the arm to a body gear configured to be worn near the user's head or neck, and subsequently detach the arm from the body gear without affecting the structural integrity of the arm and the body gear.

It is understood that other aspects of apparatuses and methods will become readily apparent to those skilled in the art from the following detailed description, wherein various aspects of apparatuses and methods are shown and described by way of illustration. As will be realized, these aspects may be implemented in other and different forms and its several details are capable of modification in various other respects. Accordingly, the drawings and detailed description are to be regarded as illustrative in nature and not as restrictive.

BRIEF DESCRIPTION OF THE DRAWINGS

Various aspects of a holder for positioning an output end of a hydration tube near a user's mouth will now be presented in the detailed description by way of example, and not by way of limitation, with reference to the accompanying drawings, wherein.

DETAILED DESCRIPTION

Disclosed herein are apparatuses, also referred to herein as holders, that attach to a person's headgear and provide for the securing and positioning of the output end of a hydration tube at a location near the person's mouth. Positioning the output end as such eliminates the need for the person to grab the dangling end of the tube to place it in his mouth. A similar apparatus that secures to a shoulder strap, such as on a backpack, is also disclosed.

Figure 1:
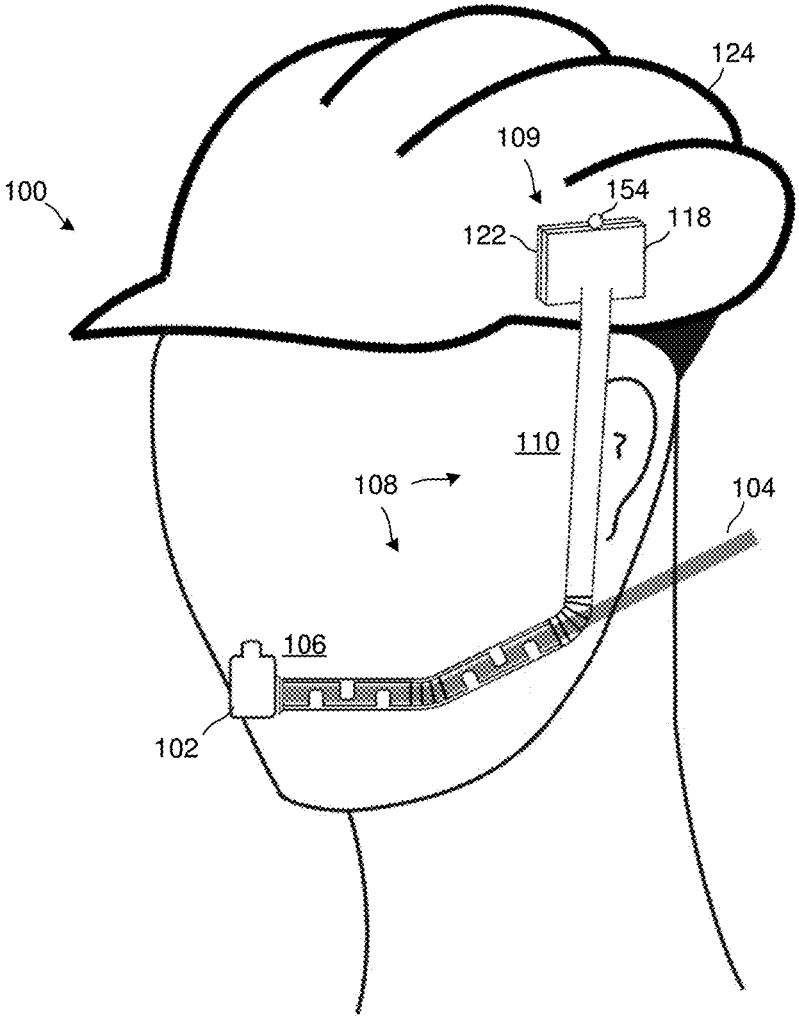
FIG. 1 is an illustration of a first embodiment of a holder for a hydration tube in association with a body gear in the form of a helmet.

With reference to FIG. 1, a first embodiment of a holder 100 for positioning an output end 102 of a hydration tube 104 near a region of a user's mouth 106 includes an arm 108 and a mounting mechanism 109. One or more portions of the arm 108 may be manually formed by the user into a shape that extends generally vertically downward along the side 110 of the user's head and then generally horizontally toward the user's mouth 106. The mounting mechanism 109 is associated with the arm 108 and is configured to attach the arm to a body gear 124, shown in FIG. 1 as a bicycle helmet, to thereby provide for fixed placement of the arm relative to the user's head. The mounting mechanism 109 is further configured to enable subsequent detachment and reattachment of the arm 108 from and to the body gear 124 without affecting or altering the structural integrity of the arm or the body gear. To this end, the mounting mechanism 109 attaches and detaches to the body gear 124 without damage or deformation to either itself or the body gear, and without requiring attachment hardware, such as screws, and associated tools.

Figure 2:
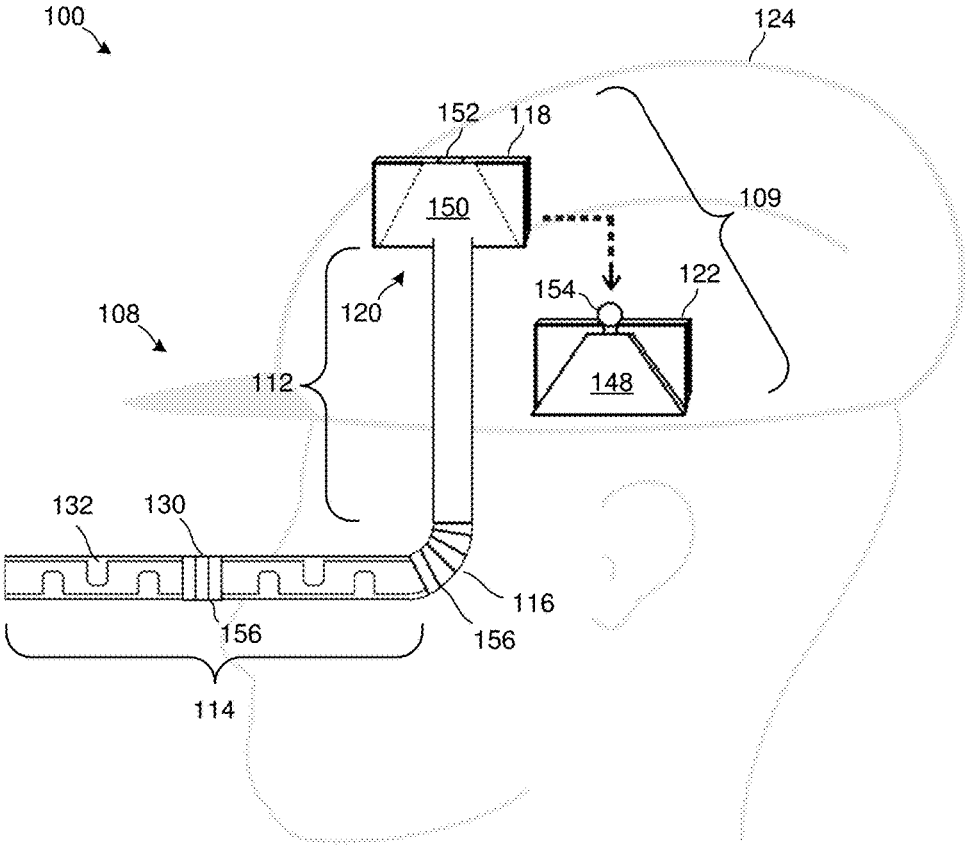
FIG. 2 is a schematic illustration of the holder of FIG. 1 from the front, including an arm and a multi-component mounting mechanism.

With additional reference to FIG. 2, in the first embodiment of the holder 100, the mounting mechanism 109 includes two separable components—namely a first base component 118 that is associated with the arm 108 and a second base component 122 that is associated with the body gear 124. The arm 108 includes a front region 114 and an side region 112, and the first base component 118 is located at an end 120 of the side region 112. The terms "side" and "front" are used herein to differentiate between the regions of the arm 108 in a manner consistent with the arrangement of the arm relative to a user as shown in the figures. These terms are not intended to be limiting in anyway.

In one configuration, the first base component 118 is fixedly secured at the end 120 of the side region 112 of the arm 108. "Fixedly secured" as used herein means that the two components cannot be separated without damaging, e.g., breaking or permanently deforming, one or both of the components. To this end, the first base component 118 may be adhered to, molded onto, or integrally formed with, the end 120 of the arm's side region 122.

With additional reference to FIGS. 3-6, the front region 114 of the arm 108 is configured to have the portion of the hydration tube 104 that includes the output end 102 attached thereto, and subsequently detached therefrom without affecting the structural integrity of the front region or the hydration tube. "Without affecting the structural integrity" as used herein means that the two components can be separated and reattached without damaging, e.g., breaking or permanently deforming, one or both of the components, and without requiring attachment hardware, such as screws, and associated tools.

Figure 5:
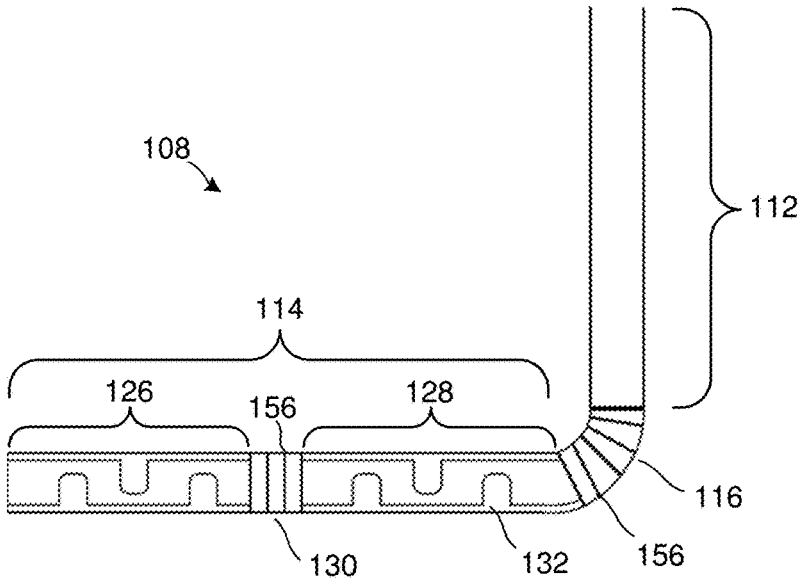
FIG. 5 is a schematic illustration of a portion of the arm of FIG. 2, including a side region and a front region with fixation structures.
Figure 6:
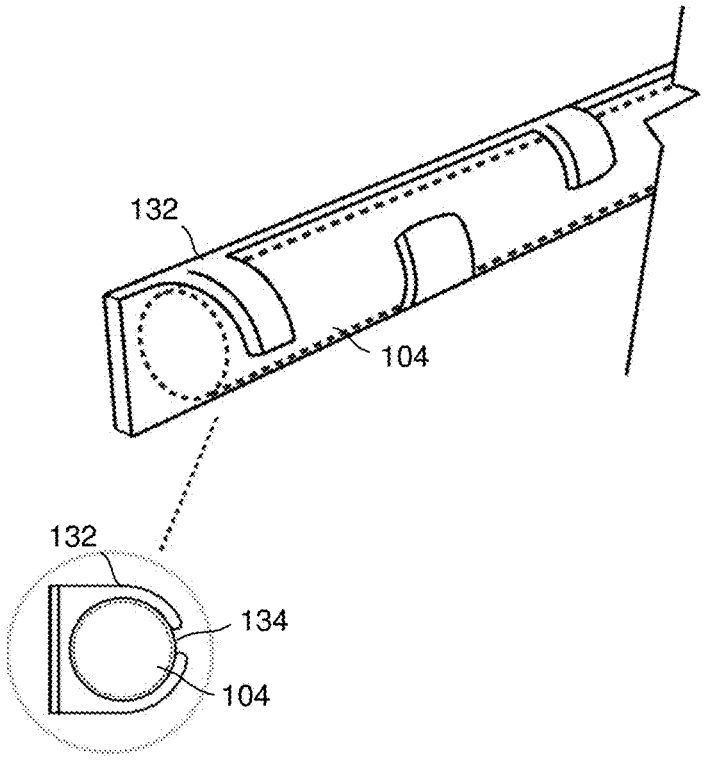
FIG. 6 is an illustration of the front region of FIG. 5, showing a portion of a hydration tube secured to the arm by fixation structures.

With reference to FIGS. 5 and 6, in one configuration, the front region 114 of the arm 108 includes a number of fixation structures 132 spaced apart along the length of the front region. The fixation structures 132 may extend outward from the top and bottom edges of the front region 114 and have a length sufficient to extend at least partially around an outer circumference 134 of the hydration tube 104. In one configuration, the fixation structures are malleable, i.e., able to be manually formed by a user into a bent shape and once bent, to retain the bent shape. Such a characteristic may be provided by forming the fixation structures 132 of a bendable wire or bendable wire mesh structure embedded in a flexible plastic material.

In one configuration, the arm 108 includes a primary flex region 116 that is interposed between the side region 112 and the front region 114. The primary flex region 116 is configured to enable displacement or movement of the front region 114 relative to the side region 112. For example, as shown in FIG. 5, the front region 114 and the side region 112 are arranged at a right angle with respect to each other to form an arm 108 lying generally flat in a two-dimensional plane. This arrangement in enabled by the primary flex region 116, which is malleable, i.e., configured to be manually formed by the user into a bent shape lying flat in a two-dimensional plane. The primary flex region 116 may also be configured to be manually formed into a substantially linear shape, in which case the side region 112 and the front region 114 would be arranged linearly with respect to each other. The primary flex region 116 may also be configured to be manually bent and twisted about an axis extending through the length of the region, in which case the portion of the arm 108 defined by the side region 112 and the front region 114 may assume a three-dimensional shape.

With continued reference to FIG. 5, in another configuration, the front region 114 of the arm 108 includes a first subregion 126, a second subregion 128, and a secondary flex region 130 that is interposed between the first subregion and the second subregion. Like the primary flex region 116 described above, the secondary flex region 130 is configured to enable displacement of the first subregion 126 relative to the second subregion 128. For example, as shown in FIG. 5, the first subregion 126 and the second subregion 128 are arranged linearly with respect to each other to form a substantially straight front region 114 lying generally flat in a two-dimensional plane. This arrangement in enabled by the secondary flex region 130, which is malleable, i.e., configured to be manually formed by the user into a straight shape lying flat in a two-dimensional plane. The secondary flex region 130 may also be configured to be manually formed into a bent shape, in which case the first subregion 126 and the second subregion 128 would be arranged at an angle with respect to each other. The secondary flex region 130 may also be configured to be manually bent and twisted about an axis extending through the length of the region, in which case the front region 114 may assume a three-dimensional shape, such as shown in FIG. 1.

In some configurations, one or more of the side region 112 and the first subregion 126 and the second subregion 128 of the front region 114 may be substantially rigid and not capable of being manually deformed. In this case, the shaping of the arm 108 relies entirely on the bending and/or twisting of one or both of the primary flex region 116 and the secondary flex region 130. In other configurations, to provide better shaping capabilities, the side region 112 and the first subregion 126 and the second subregion 128 of the front region 114 may also be configured to be manually formed and deformed by the user into one or more of a substantially linear shape, a bent shape lying flat in a plane, and a bent and twisted shape such as described above with respect to the primary flex region 116.

Regarding the structure of the various regions of the arm 108, in one embodiment, the regions 112, 116, 126, 128, 130 may be formed by a bendable wire or wire mesh embedded in a flexible plastic material. Some regions 112, 116, 126, 128, 130 may be made more flexible than other regions through one or more of a: 1) change in dimensions, 2) incorporation of surface modifications, and 3) use of different materials. For example, the side region 112 and the first subregion 126 and the second subregion 128 of the front region 114, together with the primary flex region 116 and the secondary flex region 130 may have the same width and thickness dimensions along their entire length, with the flex regions 116, 130 being made more flexible by a series of spaced apart surface modifications in the form of notches 156 or grooves in the outer surfaces.

In another embodiment, different degrees of flexibility along the arm 108 may be provided through changes in one or more of the width and thickness dimensions of the various regions 112, 116, 126, 128, 130. For example, the primary flex region 116 and the secondary flex region 130 may be thinner and/or narrower than the side region 112 and the first subregion 126 and the second subregion 128 of the front region 114.

In another embodiment, different degrees of flexibility along the arm 108 may be provided through changes in material of one or more of the regions 112, 116, 126, 128, 130. For example, the side region 112 and the first subregion 126 and the second subregion 128 of the front region 114 may be formed of a rigid plastic, while the primary flex region 116 and the secondary flex region 130 may be formed of a less rigid plastic, such as polyvinylchloride (PVC), nylon, or Teflon.

With reference to FIGS. 2-4B, the second base component 122 of the mounting mechanism 109, which component is secured to the body gear 124, is configured to have the first base component 118, which is associated with the arm 108, coupled thereto and subsequently decoupled therefrom without affecting the structural integrity of the first based component and the second base component. Again, as used herein "without affecting the structural integrity" means that the two components can be separated and rejoined without damaging, e.g., breaking, permanently deforming, one or both of the components, and without requiring attachment hardware, such as screws, and associated tools.

Figure 3:
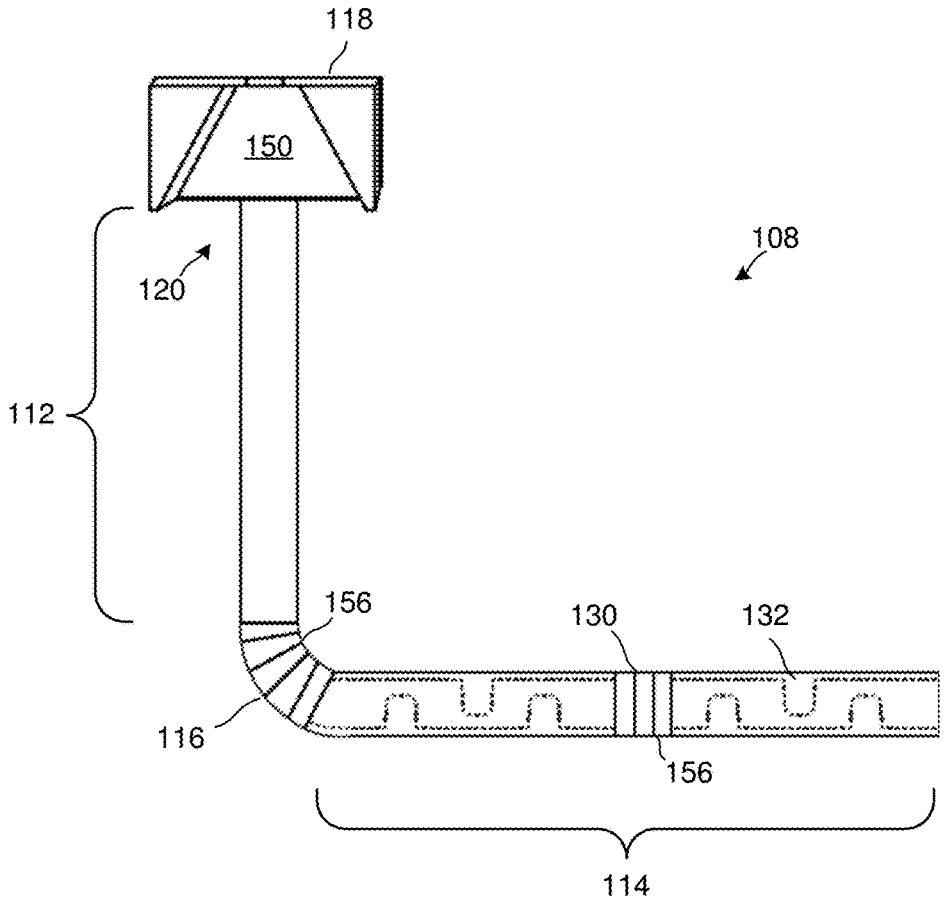
FIG. 3 is a schematic illustration of a portion of the holder of FIG. 2 from the back.

As shown in FIGS. 2, 3, 4A and 4B, in one configuration, the second base component 122 includes first structure or support 146, and an elevated structure 148 extending or elevating from the first structure. An adhesive backing 158 on the support 146 allows for the second base component 122 to be secured to the body gear 124. The elevated structure 148, herein after referred to as the elevated structure, is configured to mate with the first base component 118. To this end, the first base component 118 includes a recess 150 having a particular shape, such as a truncated triangular shape as shown in FIG. 3, and the elevated structure 148 of the second base component 122 has a shape that matches the shape of the recess.

With reference to FIG. 2, the first base component 118 and the second base component 122 are coupled together by placing the first base component over the top of the second base component such that the elevated structure 148 of the second base component 122 is aligned with the recess 150 of the first base component. Once aligned, the first base component 118 is slid down until the elevated structure 148 is fully seated in the recess 150. The elevated structure 148 and the recess 150 may be formed with locking features, e.g., groves and projections, that mate to secure the elevated structure within the recess.

Figure 4A:
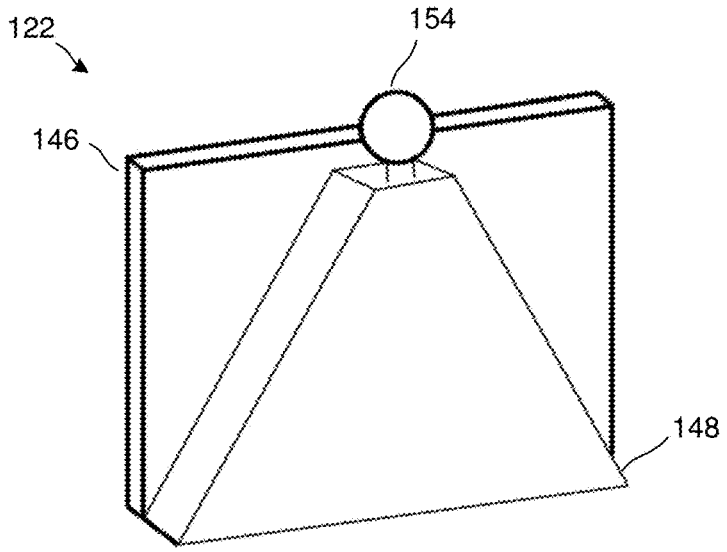
FIGS. 4A and 4B are illustrations of a component of the mounting mechanism of FIG. 2.
Figure 4B:
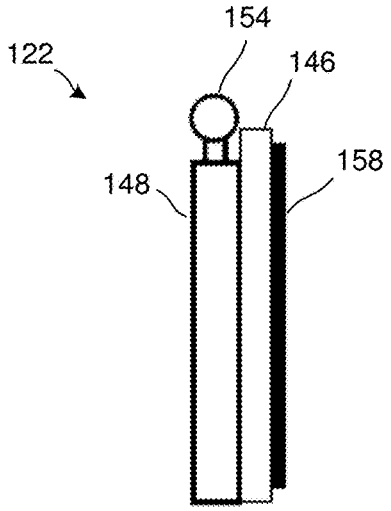

With reference to FIGS. 1, 2 and 4A, the first base component 118 may include a cutout 152, and the elevated structure 148 may include a projection 154 in the form of a sphere. The sphere 154 is configured to be forced through the cutout while the elevated structure 148 is sliding into the recess 150. As shown in FIG. 1, when the elevated structure 148 is fully seated in the recess 150, the sphere 154 is exposed through the cutout 152 and functions to further secure the elevated structure 148 within the recess 150. Subsequent decoupling of the first base component 118 and the second base component 122 is achieved by sliding the first base component upward with sufficient force to move the sphere 154 through the cutout 152 disengage the elevated structure 148 and the recess 150.

The configuration of the first base component 118 and the second base component 122 and the top/down manner in which they engage each other securely fixes the arm 108 to the body gear 124 and provides resistance against downward forces that may otherwise dislodge the arm 108 from the body gear 124. For example, during use a user may manually adjust or reform the arm 108. Such actions may result in downward or pulling forces on the arm 108. However, because the first base component 118 fits over top of the second base component 122 and because of the engagement of the elevated structure 148 within the recess 150, any downward forces at the point of attachment are countered by the components 118, 122 of the mounting mechanism 109 and movement or dislodgement of the arm 108 at the point of attachment is prevented. The terms "top," "down," "upward" and "downward" are used herein to describe the attachment of the arm 108 to the body gear 124 in a manner consistent with the arrangement of the arm, the body gear, and the components of the mounting mechanism 109 relative to a user as shown in the figures. These terms are not intended to be limiting in anyway.

Figure 7:
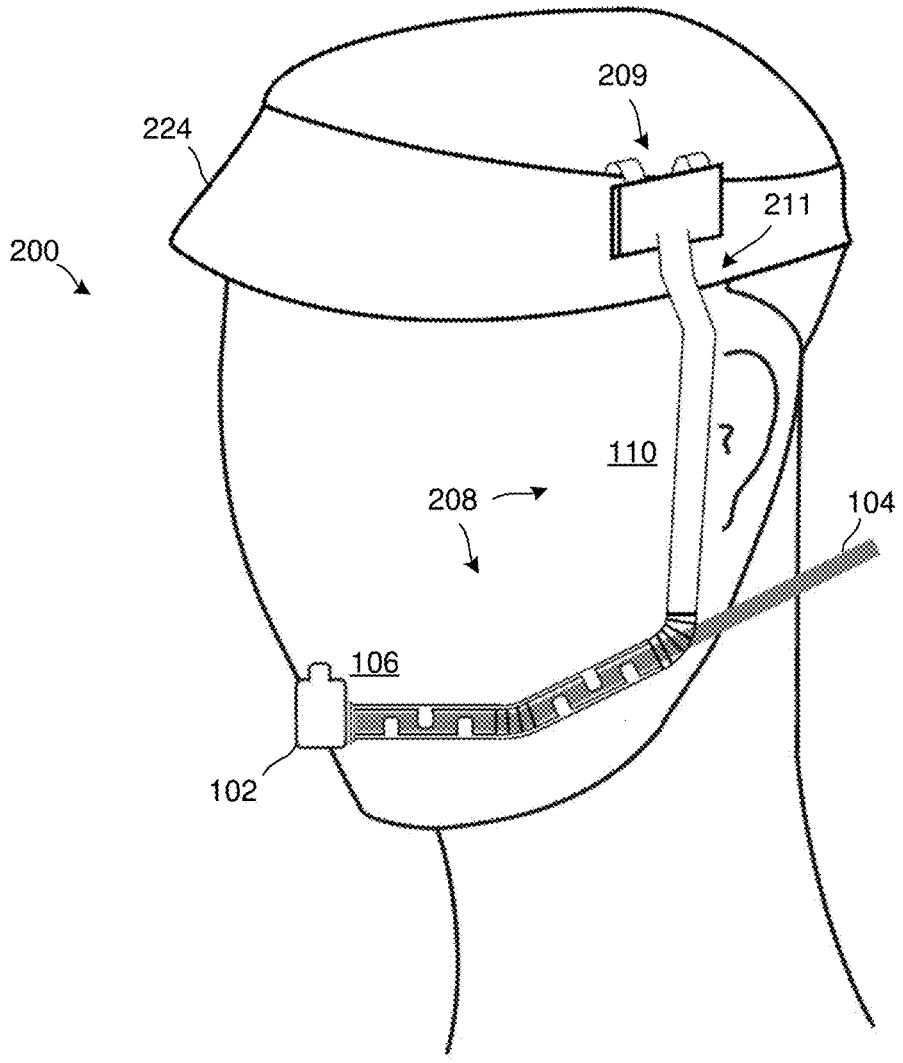
FIG. 7 is an illustration of a second embodiment of a holder for a hydration tube in association with a body gear in the form of a visor.
Figure 8:
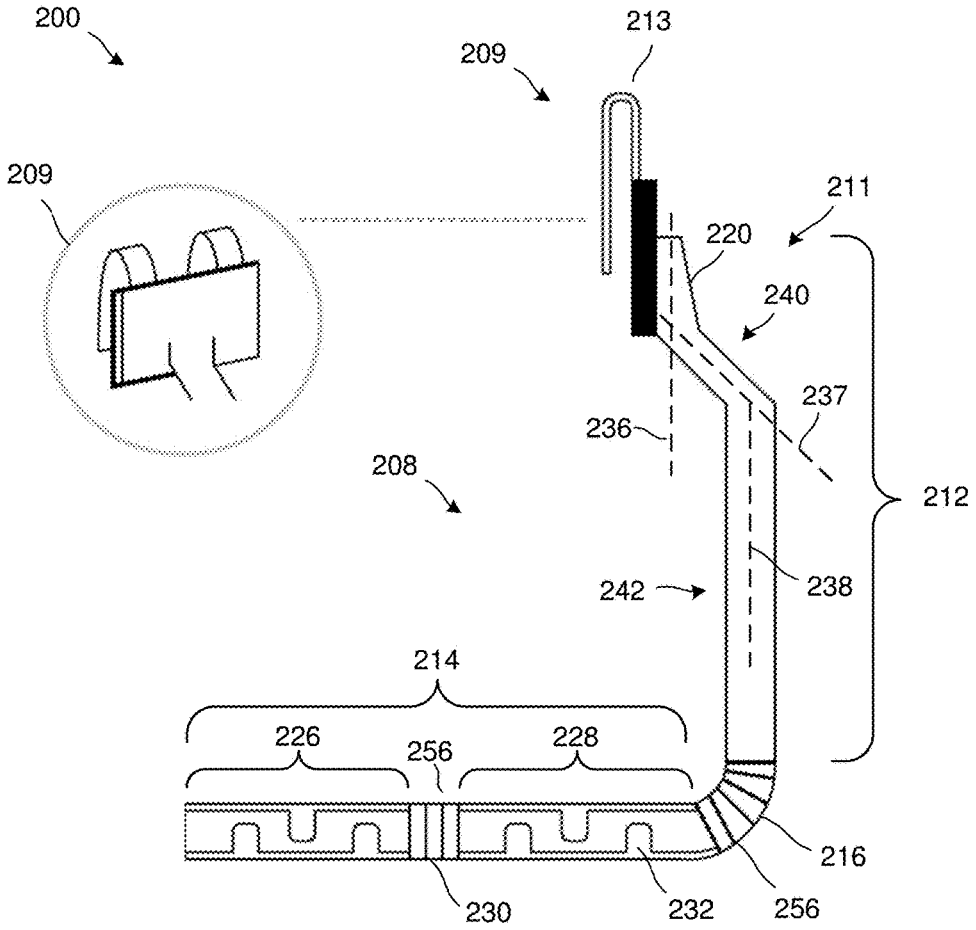
FIG. 8 is a schematic illustration of the holder of FIG. 7 from the front, including an arm and a single component mounting mechanism having hooks.

With reference to FIGS. 7 and 8, a second embodiment of a holder 200 for positioning an output end 102 of a hydration tube 104 near a region of a user's mouth 106 includes an arm 208 and a mounting mechanism 209. One or more portions of the arm 208 may be manually formed by the user into a shape that extends generally vertically downward along the side 110 of the user's head and then generally horizontally toward the user's mouth 106. The mounting mechanism 209 is associated with the arm 208 and is configured to attach the arm 208 to a body gear 224, shown in FIG. 7 as a visor, to thereby provide for fixed placement of the arm relative to the user's head. The mounting mechanism 209 is further configured to enable subsequent detachment and reattachment of the arm 208 from and to the body gear 224 without affecting the structural integrity of the arm and the body gear. The mounting mechanism 209 includes one or more structures 213, e.g., hooks, configured to secure the holder 200 to the body gear 224.

In the second embodiment of the holder 200 shown FIGS. 7 and 8, the mounting mechanism 209 is single component that is fixedly secured to the arm 208. Similar to the first embodiment shown in FIGS. 1 and 2, the arm 208 of the second embodiment includes a front region 214 and an side region 212. The mounting mechanism 209 is fixedly secured to an end 220 of the side region 212 of the arm 208. "Fixedly secured" as used herein means that the two components cannot be separated without damaging, e.g., breaking or permanently deforming, one or both of the components. To this end, the mounting mechanism 209 may be adhered to, molded onto, or integrally formed with, the end 220 of the arm's side region 212.

Like the first embodiment, the front region 214 of the arm is configured to have the portion of the hydration tube 104 that includes the output end 102 attached thereto and subsequently detached therefrom without affecting the structural integrity of the front region or the hydration tube. "Without affecting the structural integrity" as used herein means that the two components can be separated and reattached without damaging, e.g., breaking or permanently deforming, one or both of the components, and without requiring attachment hardware, such as screws, and associated tools.

The second embodiment of a holder 200 includes a preformed bend 211 in the region of the arm 208 near the mounting mechanism 209. Specifically, the side region 212 of the arm 208 is shaped to position the majority of the side region a distance away from the side of the user's head. This space between the user's head and the arm 208 is provided so that the arm does not interfere with other body gear, such as a pair of glasses that the user may be wearing. With reference to FIG. 8, the end 220 of the side region 212 of the arm 208 may be characterized by a first axis 236 extending along the length of the end. The side region 212 of the arm 208 includes a first portion 240 that is adjacent the end 220 of the side region and a second portion 242 that is adjacent the first portion. A first bend in the side region positions an axis 237 extending along the length of the first portion 240 at a first angle offset from the first axis 236, while a second bend positions an axis 238 extending along the length of the second portion 242 in a position generally parallel to the first axis.

Continuing with reference to FIGS. 7 and 8, similar to the first embodiment describe above, in one configuration, the front region 214 includes a number of fixation structures 232 spaced apart along the length of the front region. The fixation structures 232 extend outward from the top and bottom edges of the front region 214 and have a length sufficient to extend at least partially around an outer circumference of the hydration tube 104. In one configuration, the fixation structures are malleable, i.e., able to be bent and once bent, to retain the bent shape.

In one configuration, the arm 208 includes a primary flex region 216 that is interposed between the side region 212 and the front region 214. The primary flex region 216 is configured to enable displacement or movement of the front region 214 relative to the side region 212. For example, as shown in FIG. 8, the front region 214 and the side region 212 are arranged at a right angle with respect to each other to form an arm lying generally flat in a two-dimensional plane. This arrangement in enabled by the primary flex region 216, which is configured to be manually formed by the user into a bent shape lying flat in a two-dimensional plane. The primary flex region 216 may also be configured to be manually formed into a substantially linear shape, in which case the side region 212 and the front region 214 would be arranged linearly with respect to each other. The primary flex region 216 may also be configured to be manually formed into a bent and twisted shape, in which case the portion of the arm 208 defined by the side region 212 and the front region 214 may assume a three-dimensional shape.

With continued reference to FIG. 8, in another configuration, the front region 214 of the arm 208 includes a first subregion 226, a second subregion 228, and a secondary flex region 230 that is interposed between the first subregion and the second subregion. Like the primary flex region 216 described above, the secondary flex region 230 is configured to enable displacement of the first subregion 226 relative to the second subregion 228. For example, as shown in FIG. 8, the first subregion 226 and the second subregion 228 are arranged linearly with respect to each other to form a substantially straight front region 214 lying generally flat in a two-dimensional plane. This arrangement in enabled by the secondary flex region 230, which is configured to be manually formed by the user into a straight shape lying flat in a two-dimensional plane. The secondary flex region 230 may also be configured to be manually formed into a bent shape, in which case the first subregion 226 and the second subregion 228 would be arranged at an angle with respect to each other. The secondary flex region 230 may also be configured to be manually formed into a bent and twisted shape, in which case the front region 214 may assume a three-dimensional shape, such as shown in FIG. 7.

In some configurations, one or more of the side region 212 and the first subregion 226 and the second subregion 228 of the front region 214 may be substantially rigid and not capable of being manually deformed. In this case, the shaping of the arm 208 relies entirely on the shaping of one or both of the primary flex region 216 and the secondary flex region 230. In other configurations, to provide better shaping capabilities, the side region 212 and the first subregion 226 and the second subregion 228 of the front region 214 may also be configured to be manually formed and deformed by the user into one or more of a substantially linear shape, a bent shape lying flat in a plane, and a bent and twisted shape such as described above with respect to the primary flex region 216.

Similar to the first embodiment describe above, the various regions 212, 216, 226, 228, 230 of the arm 208 may be formed by a bendable wire embedded in a flexible plastic material. Furthermore, some regions 212, 216, 226, 228, 230 may be made more flexible than other regions through one or more of a: 1) change in dimensions, 2) incorporation of surface modifications, and 3) use of different materials, as described above.

Figure 9:
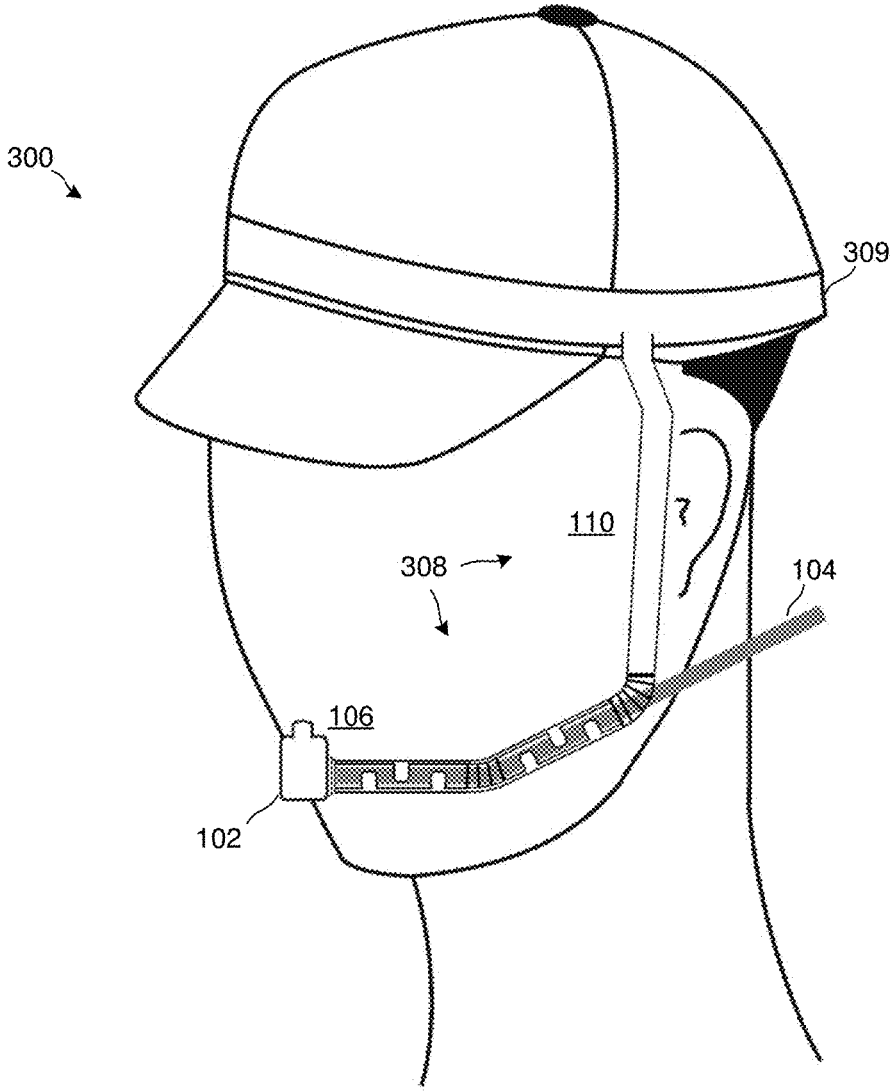
FIG. 9 is an illustration of a third embodiment of a holder for a hydration tube in association with a user's head.
Figure 10:
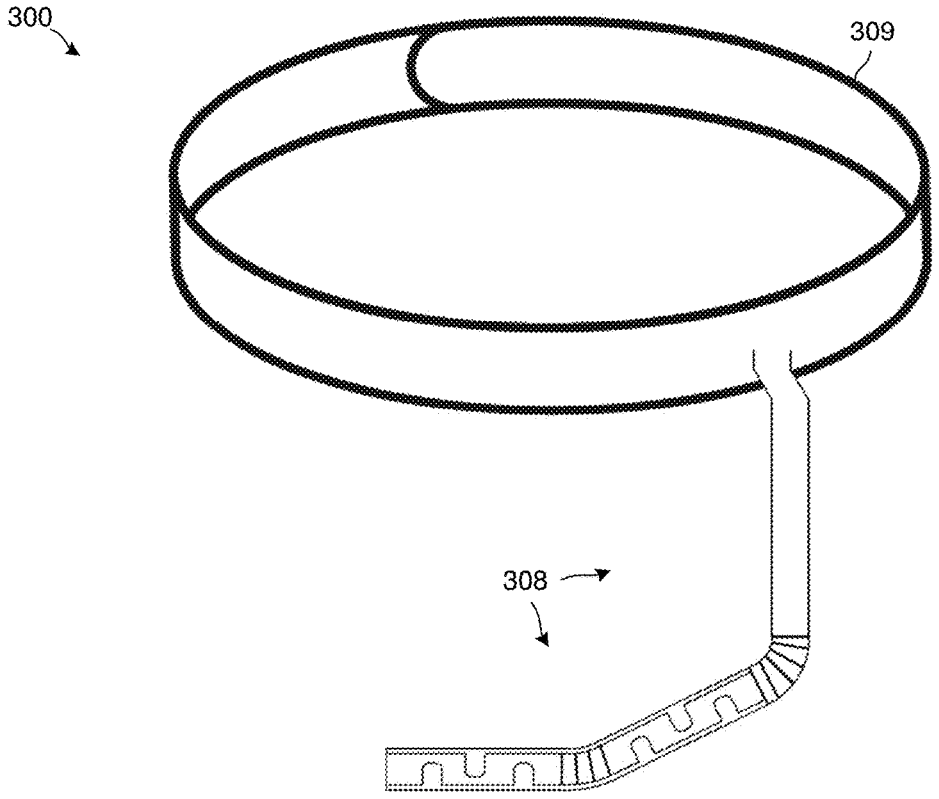
FIG. 10 is a schematic illustration of the holder of FIG. 9 from the front, including an arm and a single component mounting mechanism in the form of a head band.
Figure 11:
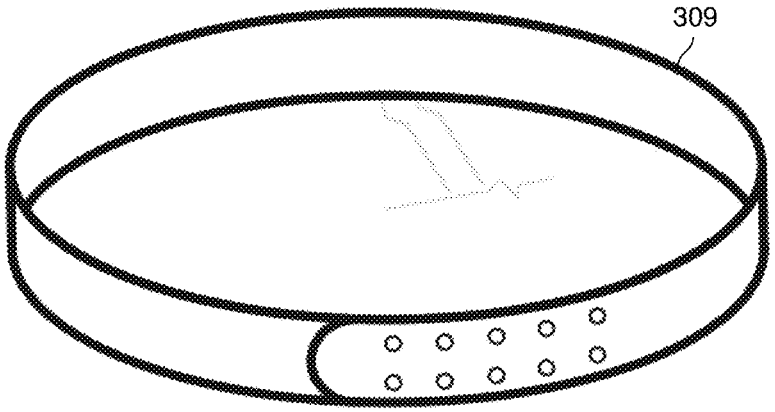
FIG. 11 is an illustration of the mounting mechanism of FIG. 9 from the back.

With reference to FIGS. 9, 10 and 11, a third embodiment of a holder 300 for positioning an output end 102 of a hydration tube 104 near a region of a user's mouth 106 includes an arm 308 and a mounting mechanism 309. As in the above embodiments, one or more portions of the arm 308 may be manually formed by the user into a shape that extends generally vertically downward along the side 110 of the user's head and then generally horizontally toward the user's mouth 106. The mounting mechanism 309 is associated with the arm 308 and is in the form of a headband configured to attach the arm 308 to the user's head, to thereby provide for fixed placement of the arm relative to the user's head. The mounting mechanism 309 is further configured to enable subsequent detachment and reattachment of the arm 308 from and to the user's head.

The arm 308 is configured as described above with reference to the arms of the first and second embodiments. Therefore, a detailed description of the arm 308 is not repeated here.

In the configuration shown in FIGS. 9, 10 and 11, the mounting mechanism 309 is a single component that is fixedly secured to the arm 308. In another configuration, the mounting mechanism 309 may include multiple components, similar to those described above with reference to the mounting mechanism 109 of the first embodiment, shown in FIG. 1. For example, the mounting mechanism 309 may include a first structure similar to the first base component 118 shown in FIG. 2 that is secured to the arm 308, and a second structure similar to the second base component 122 shown in FIG. 2 that is secured to the headband 309.

Figure 12:
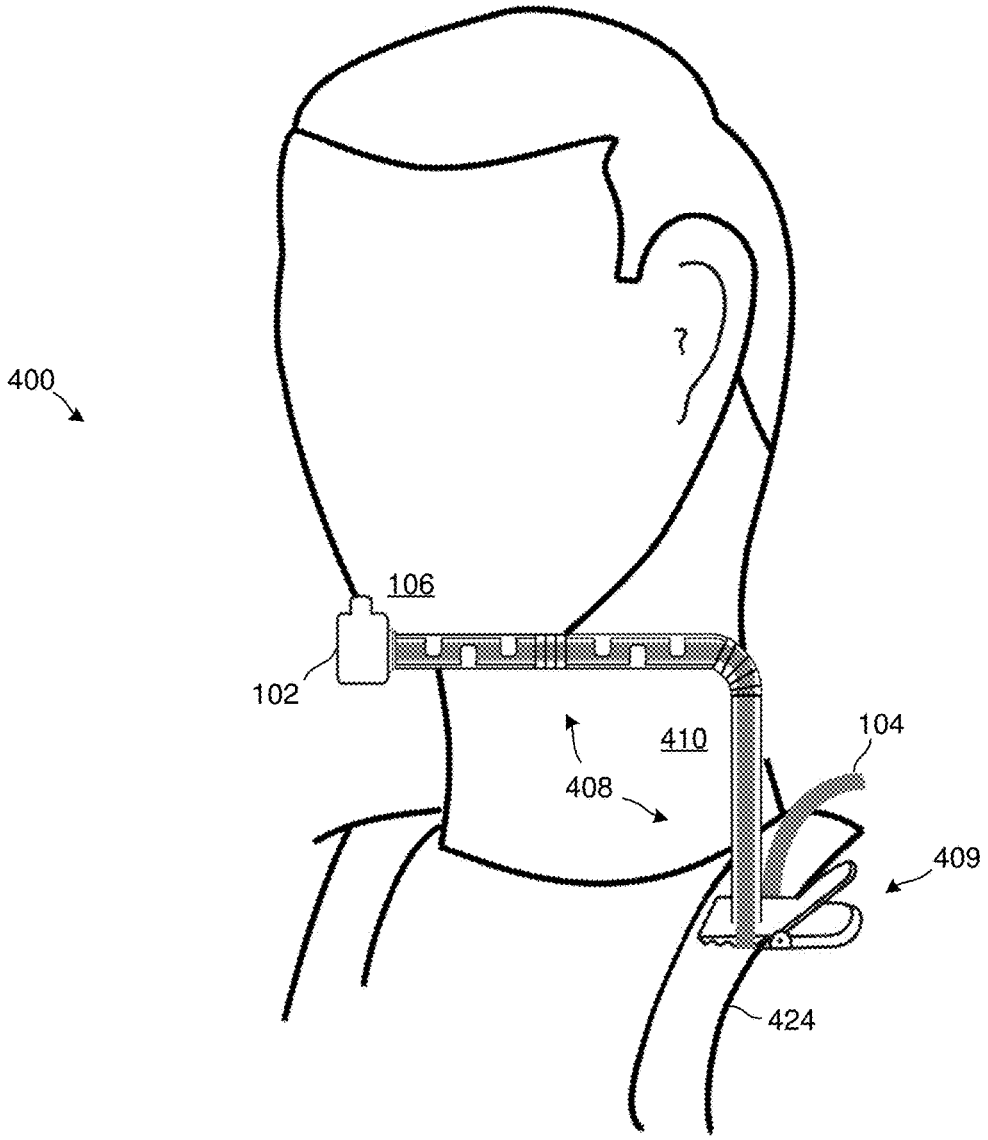
FIG. 12 is an illustration of a fourth embodiment of a holder for a hydration tube in association with a body gear in the form of a shoulder strap.
Figure 13:
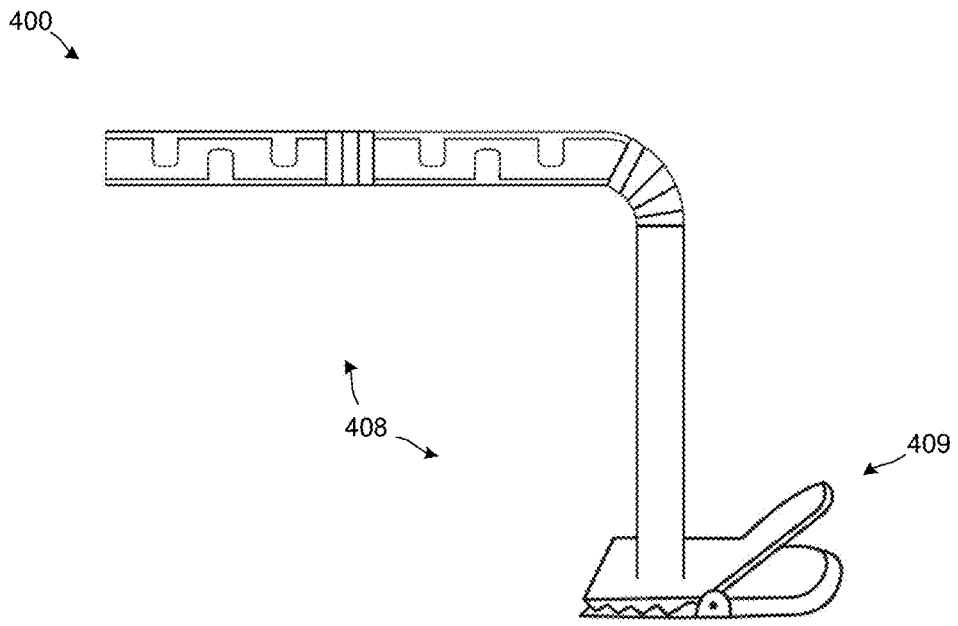
FIG. 13 is a schematic illustration of the holder of FIG. 12 from the front, including and arm and a single component mounting mechanism in the form of a clip.

With reference to FIGS. 12 and 13, a fourth embodiment of a holder 400 for positioning an output end 102 of a hydration tube 104 near a region of a user's mouth 106 includes an arm 408 and a mounting mechanism 409. One or more portions of the arm 408 may be manually formed by the user into a shape that extends generally vertically upward along the neck 410 of the user and then generally horizontally toward the user's mouth 106. The mounting mechanism 409 is associated with the arm 408 and is in the form of a clip configured to attach the arm 408 to a body gear 424, shown in FIG. 12 as a shoulder strap being worn by the user, to thereby provide for fixed placement of the arm relative to the user's head. The mounting mechanism 409 is further configured to enable subsequent detachment and reattachment of the arm 408 from and to the body gear 424.

The arm 408 is configured as described above with reference to the arms of the first and second embodiments. Therefore, a detailed description of the arm 408 is not repeated here.

Thus, disclosed herein are various apparatuses for positioning an output end 102 of a hydration tube 104 near a region of a user's mouth 106. The apparatuses include an arm 108, 208, 308, 408 and a mounting mechanism 109, 209, 309, 409. The arm 108, 208, 308, 408 is manually formable by a user to extend in a generally vertical direction along a side of the user's head 110 or neck 410 and in a generally horizontal direction toward the user's mouth 106. The arm 108, 208, 308, 408 includes a side region 112, 212 and a front region 114, 214 coupled to the side region. The front region 114, 214 is configured to have a portion of the hydration tube 104 including the output end 102 attached thereto and subsequently detached therefrom without affecting the structural integrity of the front region or the hydration tube. The mounting mechanism 109, 209, 309, 409 is associated with the arm 108, 208, 308, 408 and is configured to attach the arm to a body gear 124, 224, 324, 424 configured to be worn near the user's head or neck, and subsequently detach the arm from the body gear without affecting the structural integrity of the arm and the body gear.

The various aspects of this disclosure are provided to enable one of ordinary skill in the art to practice the present invention. Various modifications to exemplary embodiments presented throughout this disclosure will be readily apparent to those skilled in the art. Thus, the claims are not intended to be limited to the various aspects of this disclosure, but are to be accorded the full scope consistent with the language of the claims. All structural and functional equivalents to the various components of the exemplary embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for."

What is claimed is:

1. An apparatus for positioning an output end of a hydration tube near a region of a user's mouth, the apparatus comprising:

an arm formable to extend in a generally vertical direction along a side of the user's head or neck and in a generally horizontal direction toward the user's mouth, the arm including:

a side region, and a front region coupled to the side region and configured to have a portion of the hydration tube including the output end attached thereto and subsequently detached therefrom without affecting the structural integrity of the front region or the hydration tube; and a mounting mechanism associated with the arm and configured to attach the arm to a body gear configured to be worn near the user's head or neck, and subsequently detach the arm from the body gear without affecting the structural integrity of the arm and the body gear, wherein the front region comprises one or more fixation structures extending therefrom and having a length sufficient to extend at least partially around an outer circumference of the hydration tube, and the one or more fixation structures are configured to be manually formed by the user into a bent shape, and once bent, to retain the bent shape.

2. The apparatus of claim 1, wherein the arm further comprises a primary flex region interposed between the side region and the front region and configured to enable displacement of the front region relative to the side region.

3. The apparatus of claim 2, wherein the primary flex region is configured to be manually formed by the user into one or more of a substantially linear shape, a bent shape lying flat in a plane, a twisted shape, and a bent and twisted shape.

4. The apparatus of claim 2, wherein the side region and the front region are configured to be manually formed by the user into one or more of a substantially linear shape, a bent shape lying flat in a plane, a twisted shape, and a bent and twisted shape.

5. The apparatus of claim 1, wherein the front region of the arm comprises a first subregion, a second subregion, and a secondary flex region interposed between the first subregion and the second subregion, the secondary flex region configured to enable displacement of the first subregion relative to the second subregion.

6. The apparatus of claim 5, wherein the secondary flex region is configured to be manually formed by the user into one or more of a substantially linear shape, a bent shape lying flat in a plane a twisted shape, and a bent and twisted shape.

7. The apparatus of claim 5, wherein the first subregion and the second subregion are configured to be manually formed by the user into one or more of a substantially linear shape, a bent shape lying flat in a plane, a twisted shape, and a bent and twisted shape.

8. The apparatus of claim 1, wherein an end of the arm is characterized by a first axis extending along the length of the end, and the side region of the arm comprises a first portion and a second portion adjacent the first portion, and is characterized by:

a first bend that positions an axis extending along the length of the first portion at a first angle offset from the first axis; and a second bend that positions an axis extending along the length of the second portion into a position that is generally parallel to the first axis.

9. The apparatus of claim 8, wherein the first portion is immediately adjacent the end of the side region.

10. The apparatus of claim 1, wherein the mounting mechanism is at an end of the side region of the arm.

11. The apparatus of claim 10, wherein the mounting mechanism is integral with the arm.

12. The apparatus of claim 11, wherein the mounting mechanism comprises one of a hook and clip.

13. The apparatus of claim 11, wherein the mounting mechanism comprises a head band.

14. An apparatus for positioning an output end of a hydration tube near a region of a user's mouth, the apparatus comprising:

an arm formable to extend in a generally vertical direction along a side of the user's head or neck and in a generally horizontal direction toward the user's mouth, the arm including:

a side region, and a front region coupled to the side region and configured to have a portion of the hydration tube including the output end attached thereto and subsequently detached therefrom without affecting the structural integrity of the front region or the hydration tube; and a mounting mechanism associated with the arm and configured to attach the arm to a body gear configured to be worn near the user's head or neck, and subsequently detach the arm from the body gear without affecting the structural integrity of the arm and the body gear, wherein the mounting mechanism comprises:

a first base component at an end of the side region of the arm; and a second base component configured to be secured to the body gear, and further configured to have the first base component coupled thereto and subsequently decoupled therefrom without affecting the structural integrity of the first based component and the second base component, wherein the first base component comprises a first structure configured to mate with a second structure of the second base component and the first structure comprises a recess formed in the first base component and the second structure comprises an elevated section having a shape corresponding to the recess.

15. The apparatus of claim 14, wherein the first base component comprises a cutout, the second base component comprises a projection, and the projection is configured to extend through the cutout.

16. The apparatus of claim 14, wherein the first base component is fixedly secured to the end of the side region.

* * * * *